US007448419B1

(12) United States Patent
Sommerfeld

(10) Patent No.: US 7,448,419 B1
(45) Date of Patent: Nov. 11, 2008

(54) SETUP JIG FOR A ROUTER BIT

(76) Inventor: Marc S. Sommerfeld, 40328 220th St., LeMars, IA (US) 51031

( * ) Notice: Subject to any disclaimer, the term of this patent is extended or adjusted under 35 U.S.C. 154(b) by 19 days.

(21) Appl. No.: 11/228,176

(22) Filed: Sep. 16, 2005

(51) Int. Cl.
*B27C 9/00* (2006.01)

(52) U.S. Cl. ..... 144/48.1; 144/136.95; 144/48.6; 144/253.2; 144/371; 409/82; 33/639

(58) Field of Classification Search ..... 144/135.2, 144/371, 136.1, 253.1, 253.2, 286.5, 154.5, 144/136.95, 48.6, 48.1; 409/182, 218, 227, 409/229; 33/628, 636, 638, 639, 633, 201, 33/642, 832, 833, 613, 645
See application file for complete search history.

(56) References Cited

U.S. PATENT DOCUMENTS

| | | | | | |
|---|---|---|---|---|---|
| 907,735 | A | * | 12/1908 | Cain, Jr. | 408/97 |
| 1,329,970 | A | * | 2/1920 | Hauser | 408/90 |
| 2,840,921 | A | * | 7/1958 | Swanson | 33/201 |
| 3,484,945 | A | * | 12/1969 | Clark | 33/201 |
| 3,775,020 | A | * | 11/1973 | Stoutenberg | 408/115 R |
| 3,834,435 | A | | 9/1974 | McCord, Jr. | 144/144.5 |
| 3,885,612 | A | | 5/1975 | Schell | 144/145 |
| 4,085,515 | A | * | 4/1978 | Darden | 33/377 |
| 4,322,990 | A | * | 4/1982 | Benjamin et al. | 82/129 |
| 4,323,100 | A | * | 4/1982 | Silken | 144/154.5 |
| 4,406,568 | A | | 9/1983 | Rogers et al. | 409/182 |
| 4,407,344 | A | | 10/1983 | Dicke | 144/87 |
| 4,445,811 | A | * | 5/1984 | Sanders | 409/182 |
| 4,674,548 | A | | 6/1987 | Mills et al. | 144/134 D |
| 4,830,074 | A | | 5/1989 | Lundblom | 144/251 B |
| 4,966,507 | A | | 10/1990 | Hanks | 409/175 |
| 5,042,542 | A | | 8/1991 | Purviance | 144/134 A |
| 5,114,285 | A | * | 5/1992 | Brydon | 408/115 R |
| 5,573,352 | A | * | 11/1996 | Matadobra | 409/132 |
| 5,584,328 | A | | 12/1996 | Grisley | 144/145.3 |
| 5,711,356 | A | | 1/1998 | Grisley | 144/144.51 |
| 5,983,968 | A | | 11/1999 | Newman | 144/372 |

(Continued)

FOREIGN PATENT DOCUMENTS

WO WO 2004/030878 A2 4/2004

(Continued)

OTHER PUBLICATIONS

Eagle America 2002 Winter catalog, KWIK Blocks product, publication # E0201, pp. 16-17.

*Primary Examiner*—Bena Miller
(74) *Attorney, Agent, or Firm*—Woodard, Emhardt, Moriarty, McNett & Henry LLP

(57) ABSTRACT

A setup jig for a router bit for setting the desired depth of the router bit includes a profile member having a plurality of outwardly extending projections wherein each projection is shaped with a profile that corresponds to a different router bit shape. The second component of the setup jig is a support member that is constructed and arranged and cooperating with the profile member so as to enable the controlled axial movement of the profile member relative to the support member. The profile member is internally threaded and the support member is externally threaded and the selected pitch is set so as to axially move the profile member 1/32 of an inch for each 45 degrees of rotation of the profile member relative to the support member.

8 Claims, 4 Drawing Sheets

U.S. PATENT DOCUMENTS

| | | | | |
|---|---|---|---|---|
| 6,116,303 | A | 9/2000 | Hampton | 144/144.51 |
| 6,116,826 | A * | 9/2000 | Benway | 408/1 R |
| 6,736,173 | B1 | 5/2004 | Grisley et al. | 144/145.3 |
| 7,260,897 | B1 * | 8/2007 | Neff | 33/638 |

FOREIGN PATENT DOCUMENTS

| | | |
|---|---|---|
| WO | WO 2004/030878 A3 | 4/2004 |

* cited by examiner

SETUP JIG FOR A ROUTER BIT

BACKGROUND OF THE INVENTION

The present invention relates in general to setup jigs and tooling for wood-working routers and router bits. The present invention may also find applicability in gauge designs for setting the depth or positioning of various cutting tools. More specifically, the present invention relates to a setup jig for a router bit in order to set the desired router bit depth (i.e., height adjustment) for a selected style of cutting profile in the workpiece based upon the style of router bit selected.

In terms of the prior art, the most common apparata and method for making router bit height adjustments is to select and then use a wooden block that has been machined with the selected bit profile or style, set at a predetermined or standard height which would determine its relative position in the workpiece. The desired block is selected and positioned on the router base plate and the router bit is loosened within the chuck or collet so that it can be extended. The router bit is moved axially into or out of the opening in the router base plate until the cutting or machining contours of the router bit match the machined form (profile) of the wooden block. In order to provide a variety of options for various wood-working projects, a plurality of blocks are required. Each block provides a single style of router shape, cut, or profile and a single depth or height for the corresponding cut. Most prior art products offer a limited number of cutting depth variations for a particular style or shape, if any. However, if a wood-worker wanted design and depth variations, such as having eight different router bit shapes or styles with two cutting depth choices each, a total of sixteen individual blocks would be required. As one alternative to this, the wood-worker could use a set of eight blocks for the eight different router bit shapes or styles and then use some type of spacer or shim stock beneath the individual block in order to vary the positioning of that profile between the outer planar surfaces of the selected workpiece.

In view of the number of different blocks and pieces and considering how difficult it might be to use spacers or shims to accurately vary the position of the profile within the workpiece, it would be an improvement to what presently exists if multiple router bit shapes or styles (profiles) could be integrated into one setup jig. Another improvement opportunity would be the ability to vary the height adjustment of the profile so as to provide a wider range in terms of acceptable workpiece thicknesses from some minimum thickness to maximum thickness compatible with the selected router bit profile. Within this minimum to maximum range, it would be an improvement to be able to incrementally select the desired height in an easily adjustable, accurate, and reliable manner.

The present invention is directed to overcoming the problems, disadvantages, and drawbacks of the prior art gauge blocks by integrating multiple router bit profiles into a single setup jig that also enables incremental height adjustments between minimum and maximum values. These incremental height adjustments allow the selected router bit profile to be located at different places within the thickness of the selected workpiece, depending on the particular project. All of this, as provided by the present invention, is created in a user-friendly, low-cost device that is precise and reliable.

BRIEF SUMMARY OF THE INVENTION

A setup jig for a router bit according to one embodiment of the present invention comprises a profile member including a plurality of outwardly extending projections, each projection of the plurality having a profile that corresponds to a different router bit shape and a support member constructed and arranged and cooperating with the profile member so as to enable the controlled axial movement of the profile member relative to the support member.

One object of the present invention is to provide an improved setup jig for a router bit.

Related objects and advantages of the present invention will be apparent from the following description.

DETAILED DESCRIPTION OF THE INVENTION

Figure 1:
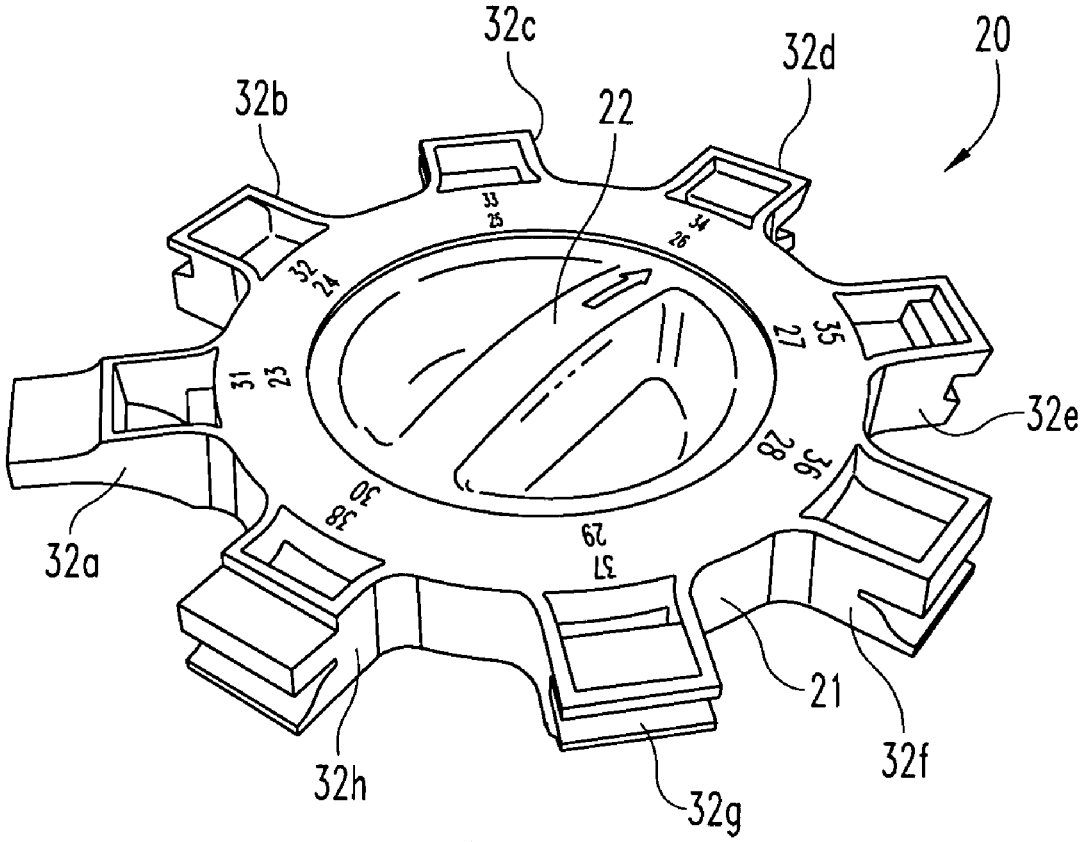
FIG. 1 is a perspective view of a setup jig for a router bit according to a typical embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIGS. 1-7, there is illustrated a setup jig 20 for a router bit according to a preferred embodiment of the present invention. Setup jig 20 is a threaded assembly of two unitary component parts including an outer, annular ring-shaped profile ring 21 (see FIGS. 2-4) and an inner, support disk 22 (see FIGS. 5-7). Ring 21 and disk 22 are each injection molded using a suitable ABS plastic material.

Profile ring 21 is open in the center and the generally cylindrical outer wall 25 is internally threaded for receipt of support disk 22. Upper wall 26 defines opening 27 while outer wall 25 defines enlarged opening 27*a*. Openings 27 and 27*a* receive support disk 22 with inner dial portion 28 of support disk 22 extending through opening 27. The upper surface 29 of wall 26 includes axial height markings in 1/32 of an inch increments beginning with 23/32 of an inch and extending to 1 3/16 of an inch. These various axial height markings translate into an indication of where the selected router bit cut or profile will be axially positioned relative to the thickness of the selected workpiece (not illustrated). Two rings of markings are provided with the inner ring of markings corresponding to the first rotation of ring 21 and the outer ring of markings corresponding to the second rotation.

Outer wall 25 is in unitary construction with eight, equally-spaced router profile projections 32*a*-32*h*. Each projection, noting that they are equally spaced on 45 degree radial centerlines, has a unique router profile that corresponds to a different router bit shape. In the preferred embodiment, the eight selected profiles include profiles for a lock miter bit 32*f*, a reverse glue joint bit 32*g*, a drawer lock bit 32*d*, a raised panel bit 32*a*, a cope cutter of stile and rail raised panel set 32*b*, a cope cutter of glass panel set 32*h*, a 22½ degree lock-bit 32*c*, and a tongue and groove cutter 32*e*. While these are believed to be the preferred router shapes for a majority of wood-working projects, it is to be understood and is contemplated as part of the present invention that different groupings of router bit profiles can be included in any type of special or custom profile ring and alternatives will be offered based upon standard packages of eight projections that would constitute the most common router bit styles for different types of wood-working projects.

Figure 8:
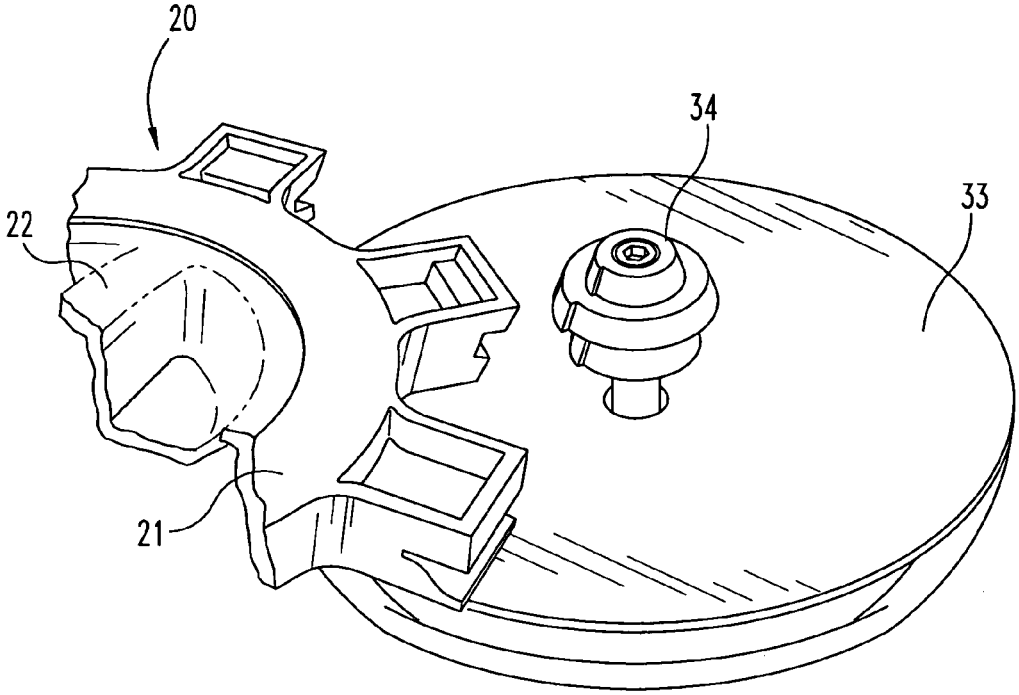
FIG. 8 is a partial perspective view of one portion of the FIG. 1 setup jig as positioned beside a router bit extending out of a router base plate according to the present invention.

By placing support disk 22 flat on the router base plate 33 (see FIG. 8), and selecting the desired router bit profile from the group of eight projections 32*a*-32*h*, the correct or desired router bit 34 height, i.e., the extension or length of the bit beyond the router base plate 33, is able to be set. As a wood-worker would readily know, the chuck or collet that secures the router bit is simply loosened to the point that the router bit can be moved axially into or out of the router base plate, thereby changing the height or depth of the router bit. The wood-worker simply extends the router bit 34 beyond the base plate 33 so as to line up the cutting edges and shapes of the router bit 34 with the shapes of the selected cut profile from profile ring 21, see FIG. 8. In this way, once there is a profile-to-bit alignment, the router bit is at the "proper" height for the desired depth of cut in order to create the selected profile in the workpiece.

It will be understood that with the profile ring 21 and its projections 32*a*-32*h* laying flat on the router base plate 33, the positioning of each portion of the selected profile (i.e., the selected projection) corresponds to where each portion will be located in the workpiece relative to the workpiece surface or side that contacts the router base plate 33. As a result of this fact, the prior art height adjustment blocks correspond to a single workpiece thickness, or at least a recommended, but very narrow or limited, thickness range. If the selected workpiece is thinner or thicker so as to fall outside of this recommended thickness range, one of two outcomes are anticipated. First, if the workpiece is thinner than the recommended range, there may not be sufficient stock on both sides of the router bit cut in order to support that cut and ultimately support the joint or use that is intended for that router cut. If the workpiece is significantly greater in thickness than the recommended thickness range, then the locating of the router cut in the workpiece can be disproportionately skewed to one side surface or the other of the workpiece. If, as is normally the case, the router cut is to be generally centered in the workpiece, then with a thicker workpiece that is otherwise outside of the recommended range, some type of height adjustment should be made to the prior art gauge blocks. This adjustment would typically be accomplished by placing some piece of stock or shim beneath the gauge block so as to raise up the profile and locate it more towards the center of the workpiece.

The present invention enables this type of height adjustment for centering the router cut into the thicker workpiece by means of the threaded engagement between profile ring 21 and support disk 22. With the support disk 22 set flat against the router base plate 33, as the profile ring is turned in a counter clockwise direction, its axial height relative to the router base plate increases. By calculating the thread pitch of the profile ring and support disk, it is possible to determine the degrees of counterclockwise rotation of profile ring 21 that will correspond, for example, to a 1/32 of an inch of axial travel. Using this as a reference dimension, a pitch of 4 threads per inch means that one rotation or revolution of the profile ring around the support disk (360 degrees) corresponds to axial travel of 1/4 of an inch. This in turn means that 45 degrees of rotation of the profile ring 21 around the support disk 22 corresponds to 1/32 of an inch of axial travel. The axial height markings are located on line (radial centerlines) with each of the eight projections 32*a*-32*h* and thus each radial centerline to radial centerline movement of 45 degrees corresponds to 1/32 of an inch of axial travel. In terms of the present invention and the thicknesses provided for the profile ring 21 and support disk 22, it is intended for the axial height to extend from 23/32 of an inch up to as much as 1 3/16 of an inch. These axial height dimensions correspond to the height of upper surface 29 of upper wall 26 relative to the undersurface of support disk 22 which is placed flat and flush against the router base plate 33. Numbers are placed on the radial centerlines corresponding to the centerline of each projection with the inner ring of numbers corresponding to the first rotation or revolution and the second (outer) ring of numbers corresponding to the second rotation or revolution of the profile ring 21 around the support disk 22. Approximately two full counter clockwise rotations of profile ring 21 around support disk 22 will increase the height of upper surface 29 from the starting dimension of 23/32 of an inch up to the suggested maximum of 1 3/16 inches. To reach 1 3/16 inches, the second rotation is roughly 45 degrees shy of a full 360 degree rotation. However, as noted, by simply reshaping and configuring profile ring 21 such that it is thicker, and similarly by reshaping support disk 22 so that it is correspondingly thicker, additional threads can be added and threaded engagement can still be maintained going to a much higher or greater axial height for profile ring 21 above baseplate 33.

Figure 2:
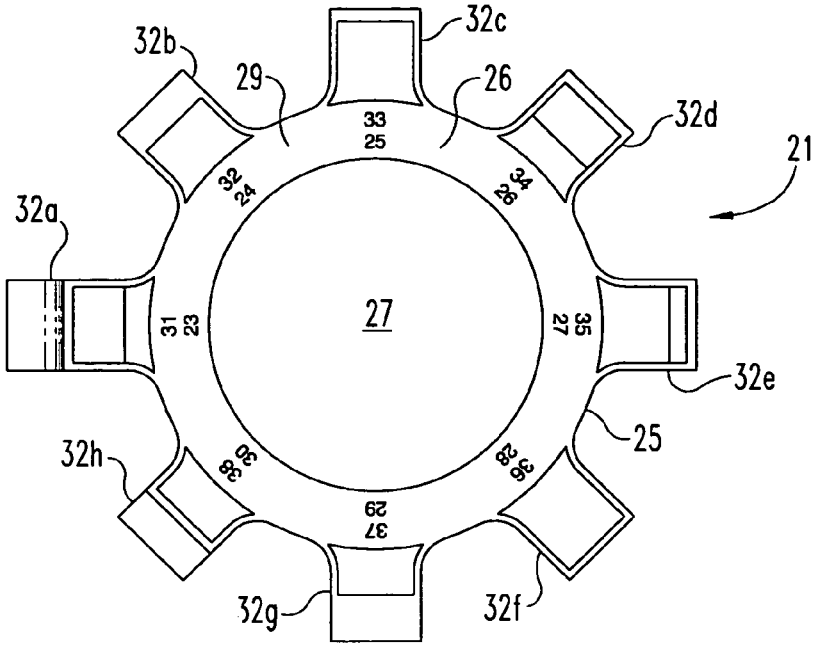
FIG. 2 is a top plan view of a profile ring comprising one component of the FIG. 1 setup jig.
Figure 3:
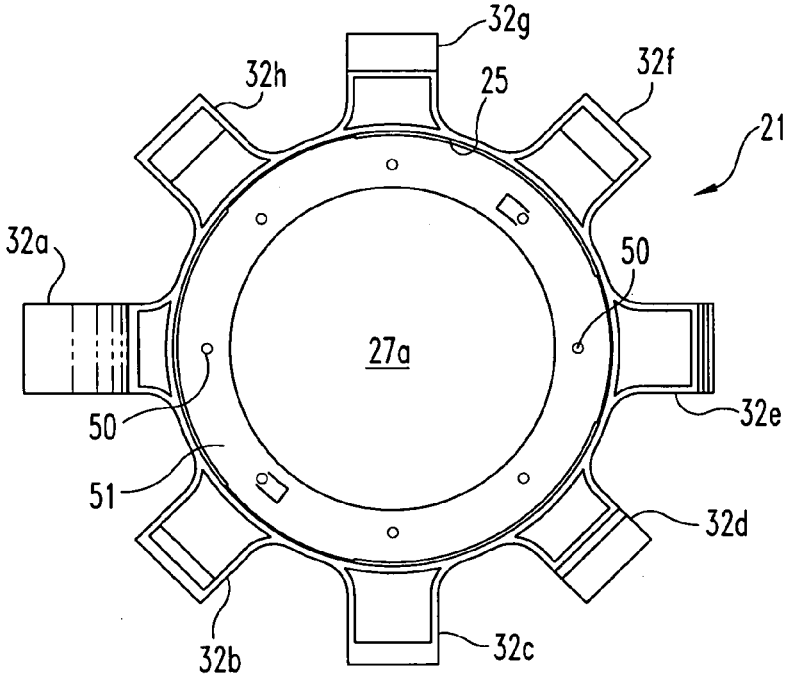
FIG. 3 is a bottom plan view of the FIG. 2 profile ring.
Figure 4:
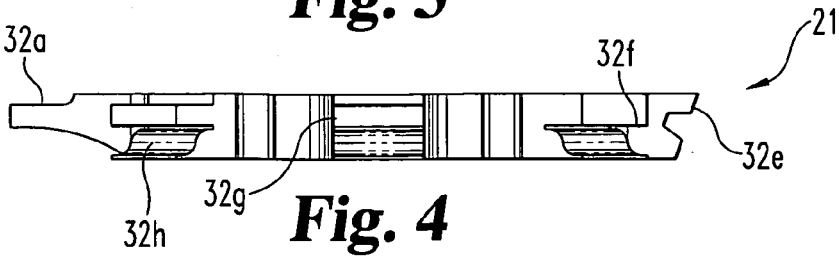
FIG. 4 is a front elevational view of the FIG. 2 profile member.
Figure 5:
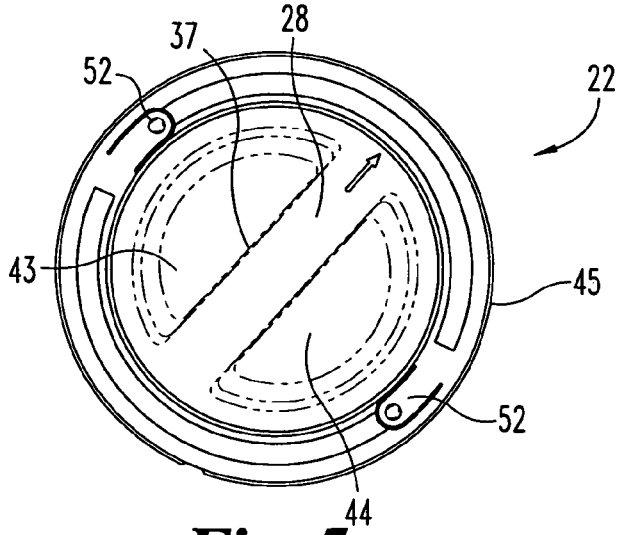
FIG. 5 is a top plan view of a support disk comprising another component of the FIG. 1 setup jig.
Figure 6:
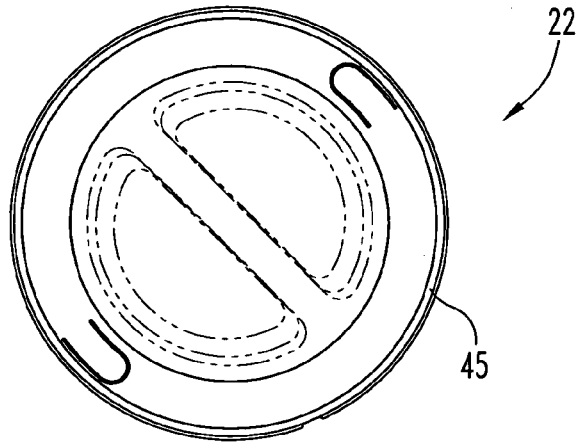
FIG. 6 is a bottom plan view of the FIG. 5 support disk.
Figure 7:
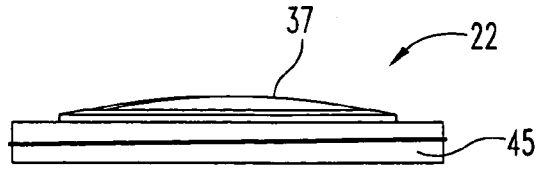
FIG. 7 is a front elevational view of the FIG. 5 support disk.
Figure 9:
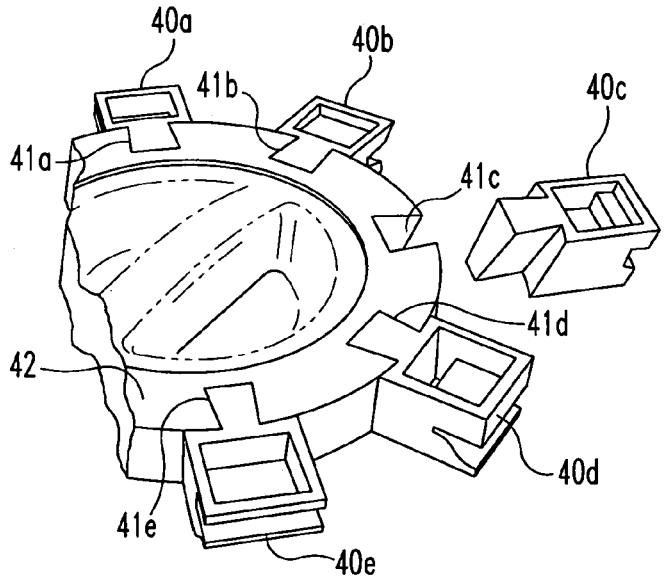
FIG. 9 is an exploded view of an alternate embodiment for a setup jig for a router bit according to the present invention.

Referring now to FIGS. 2-4, the structural configuration of profile ring 21 is illustrated in detail. The unitary construction of profile ring 21 lends itself to both molded plastic and cast metal materials for its unitary fabrication. This unitary fabrication also means that each projection 32*a*-32*h* is molded or cast as part of the remainder of the profile ring integral with outer wall 25. As noted, each projection 32*a*-32*h* has its own unique router cut profile that matches one of the eight most common or popular router bit shapes. If other or additional router bits are desired, a second or even a third ring can be created with those router bit profiles so as to expand the number of available profiles while still enabling the same support disk to be used. In terms of certain wood-working projects, it is anticipated that the various profile rings and the selection of the eight profiles could be selected based on a particular project such as cabinet making or table construction, etc. Another embodiment of the present invention, as illustrated in FIG. 9, configures the profile ring with eight (8) interchangeable, replaceable projection modules, five of which, modules 40*a*-40*e*, are illustrated. Each module 40 is constructed and arranged to fit into any one of eight (8) cooperating receiving channels or pockets, five of which, pockets 41*a*-41*e*, are illustrated. Each pocket 41 is formed into profile ring 42. In terms of securing the individual projection modules within the receiving channels, it is thought that some type of dovetail configuration, perhaps with a tapered sidewall, would be suitable as this would prevent any radial pull out of the individual modules while at the same time preventing those modules from dropping or falling through the remainder of the profile ring. However, each individual module could be easily and readily lifted up and out of the corresponding receiving pocket 41*a*-41*e*, enabling a different module 40*a*-40*e* to be inserted.

This alternative design for the setup jig, according to the present invention, while not necessarily as cost effective as setup jig 20 due to the number of separate piece parts, still provides interesting and expanded versatility. If someone wishes to work with more than eight router bits and does not want to invest in two or three rings, since those rings may in fact have certain duplications based on standard wood-working projects, the FIG. 9 alternative allows the wood-worker to purchase only the specific router bit profiles that he or she desires and then position and place those within the receiving pockets and an eight-profile ring is created. By using a common configuration for the various receiving pockets, any projection module will fit into any pocket, providing total versatility and flexibility.

A further variation to the present invention is to change the 45 degree radial centerline spacing between projections 32*a*-32*h* on profile ring 21 and the radial centerline spacing between receiving pockets 41 on profile ring 42 in order to change the number of profile projections and the number of receiving pockets. Changing from 45 degrees to 36 degrees still permits equal spacing for ten projections and/or ten receiving pockets. Changing the radial line spacing for the profile projections and receiving pockets from 45 degrees to 60 degrees reduces the number of projections and/or receiving pockets to six.

Referring again to FIGS. 5-7, the details of support disk 22 are illustrated. In addition to dial portion 28 with rib 37, this unitary structure includes a pair of recessed finger pockets 43 and 44 on opposite sides of rib 37. Outer cylindrical wall 45 is externally threaded for the threaded engagement with profile ring 21. Structurally, support disk 22 is preferably a thin-wall component throughout. The preferred unitary construction for support disk 22 is suitable for molded plastic as well as cast metal. Rib 37 provides a convenient gripping portion for holding and positioning the setup jig 20 on the router baseplate 33. One positioned, if the axial height of profile ring 21 (or 42) needs to be adjusted, rib 37 enables the user to fix and hold the position of support disk 22 while the profile ring is turned.

A further feature of the present invention includes a detent positioned at each radial centerline corresponding to the centerline of each projection 32*a*-32*h*. The detent includes a recessed divot 50 positioned on each radial centerline as part of the underside surface 51 of upper wall 26 of the profile ring 21. The cooperating portion of the detent includes a deflecting tab 52 that is formed as part of the support disk 22. The deflecting tab 52 includes a raised portion to cooperate with each divot 50. A pair of deflecting tabs 52 are used for the preferred embodiment of the present invention. When a deflecting tab 52 contacts one of the divots 50, there is an audible "click" and a tactile feel, confirming that one of the 1/32 inch heights has been selected. This feature does not preclude selecting some intermediate height between the 1/32 inch markings where the divots 50 are located.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A setup jig for a router bit comprising:

a unitary profile member including a plurality of outwardly extending projections, each projection of said plurality of projections having a profile that corresponds to a different router bit shape selected from the group consisting of a lock miter bit, a reverse glue joint bit, a drawer lock bit, a raised panel bit, a cope cutter of stile and fail raised panel set, a cope cutter of glass panel set, a 22½ degree lock-bit, and a tongue and groove cutter;

a support member being constructed and arranged for cooperating with said profile member so as to enable the controlled movement of said profile member relative to said support member;

wherein said profile member is constructed and arranged as an annular ring, said support member is constructed and arranged as a disk, said profile member and said support member are each compatibly threaded such that said profile member threads onto said support member; and said profile member and said support member each having a selected thread pitch such that counter clockwise rotation of said profile member about said support member causes said profile member to move axially approximately 1/32 of an inch for each approximate 45 degrees of rotation.

2. The setup jig of claim 1 wherein said profile member includes eight projections arranged on equally-spaced radial lies approximately 45 degrees apart, each projection being constructed and arranged with a different profile.

3. A setup jig for a router bit comprising:

a unitary profile member including a plurality of outwardly extending projections, each projection of said plurality of projections having a profile that corresponds to a different router bit shape selected from the group consisting of a lock miter bit, a reverse glue joint bit, a drawer lock bit, a raised panel bit, a cope cutter of stile and rail raised panel set, a cope cutter of glass panel set, a 22½ degree lock-bit, and a tongue and groove cutter;

a support member being constructed and arranged for cooperating with said profile member so as to enable the controlled movement of said profile member relative to said support member;

wherein said profile member and said support member are each compatibly threaded such that said profile member threads onto said support member; and said profile member and said support member each having a selected thread pitch such that counter clockwise rotation of said profile member about said support member causes said profile member to move axially approximately 1/32 of an inch for each approximate 45 degrees of rotation.

4. The setup jig of claim 3 wherein said profile member includes eight projections arranged on equally-spaced radial lines approximately 45 degrees apart, each projection being constructed and arranged with a different profile.

5. A method of setting the depth for a selected router bit as installed into a router for creating a desired profile cut in a workpiece, said router including a base plate and said router bit being axially movable relative to said base plate, said method comprising the following steps:

(a) providing a profile member having a plurality of outwardly extending projections, each projection having a profile that corresponds to a different router bit shape;

(b) providing a support member that is constructed and arranged for cooperating with said profile member so as to enable the controlled axial movement of said profile member relative to said support member;

(c) assembling said profile member and said support member together by means of threaded engagement;

(d) inverting the router with the desired router bit installed and upwardly extending beyond the base plate of the router;

(e) selecting the desired projection from the plurality of outwardly extending projections and positioning said desired projection adjacent said router bit;

(f) axially moving the router bit so as to align the router bit with the profile of the selected projection; and (g) securing the router bit in the router at the desired depth based upon step (f).

6. A setup jig for a router bit comprising:

a unitary profile member including a plurality of outwardly extending projections, each projection of said plurality of projections having a profile that corresponds to a different router bit shape;

a support member being constructed and arranged for cooperating with said profile member so as to enable the controlled movement of said profile member relative to said support member; and wherein said profile member and said support member are each compatibly threaded such that said profile member threads onto said support member, said profile member and said support member each having a selected thread pitch such that counter clockwise rotation of said profile member about said support member causes said profile member to move axially approximately 1/32 of an inch for each approximate 45 degrees of rotation.

7. A tooling gauge for setting a desired position for a plurality of different cutting tool bits, said tooling gauge comprising:

a unitary first member including a plurality of outwardly extending projections, each projection of said plurality of projections having a profile that corresponds to a different cutting tool bit shape;

a second member being constructed and arranged for cooperating with said first member so as to enable the controlled movement of said first member relative to said second member; and wherein said first member and said second member are each compatibly threaded such that said first member threads onto said second member, said first member and said second member each having a selected thread pitch such that counter clockwise rotation of said first member about said second member causes said first member to move axially approximately 1/32 of an inch for each approximate 45 degrees of rotation.

8. The tooling gauge of claim 7 wherein said first member includes eight projections arranged on equally-spaced radial lines approximately 45 degrees apart, each projection being constructed and arranged with a different profile.

* * * * *

UNITED STATES PATENT AND TRADEMARK OFFICE

CERTIFICATE OF CORRECTION

PATENT NO. : 7,448,419 B1
APPLICATION NO. : 11/228176
DATED : November 11, 2008
INVENTOR(S) : Marc S. Sommerfeld It is certified that error appears in the above-identified patent and that said Letters Patent is hereby corrected as shown below:

Column 5,
Line 36, replace “One” with -- Once --.

Column 6,
Line 3, replace “fail” with -- rail --.
Line 22, replace “lies” with -- lines --.

Signed and Sealed this

Sixth Day of January, 2009

JON W. DUDAS
*Director of the United States Patent and Trademark Office*